United States Patent [19]

Westbrook

[11] 4,134,545

[45] Jan. 16, 1979

[54] APPARATUS FOR RECIRCULATING HEATED AIR

[76] Inventor: Bobby J. Westbrook, Rte. 4, Waxiehachie, Tex. 75165

[21] Appl. No.: 811,377

[22] Filed: Jun. 29, 1977

[51] Int. Cl.[2] ..... F24D 5/04

[52] U.S. Cl. ..... 237/53; 98/33 A

[58] Field of Search ..... 98/33 R, 33 A, 40 C; 126/110 B; 219/369-371; 237/50, 53

[56] References Cited

U.S. PATENT DOCUMENTS

| | | | |
|---|---|---|---|
| 2,457,818 | 1/1949 | Heiman | 126/110 B |
| 2,534,618 | 12/1950 | Moore, Jr. | 237/53 X |
| 3,000,290 | 9/1961 | Rodick et al. | 98/40 C X |
| 3,120,225 | 2/1964 | Stark et al. | 126/110 B |
| 3,295,749 | 1/1967 | Bedell et al. | 126/110 B X |
| 3,357,088 | 12/1967 | Hoffmann et al. | 237/53 X |
| 3,474,720 | 10/1969 | Qualley et al. | 98/33 R |
| 3,973,749 | 8/1976 | Whiteley | 98/33 A |
| 4,053,732 | 10/1977 | Carter | 98/33 A X |

*Primary Examiner*—William E. Wayner
*Assistant Examiner*—William E. Tapolcai, Jr.
*Attorney, Agent, or Firm*—Wofford, Felsman, Fails & Zobal

[57] ABSTRACT

An apparatus for recirculating heated air within a building. A forced air heater with a blower is positioned in the building. A collecting tank is located near the ceiling. The collecting duct has perforations for collecting heated air that has risen to the ceiling. A return duct is connected between the collecting duct and the heater intake. The heater blower draws the heated air through the collecting duct and return duct and discharges it into the room.

2 Claims, 3 Drawing Figures

APPARATUS FOR RECIRCULATING HEATED AIR

BACKGROUND OF THE INVENTION

1. Field of the Invention

This invention relates in general to heating systems for building structures and in particular to a system that uses a forced air space heater with means for recirculating heated air.

2. Description of the Prior Art

Many buildings that contain large open spaces are heated by forced air space heaters. These buildings may serve as warehouses, factories, shops, chicken houses, and the like. These heaters normally contain a burner, a heat exchanger, and a blower for blowing air through the heat exchanger out into the room. Normally they are suspended about ten feet above the floor. The discharged air rises to the ceiling, and the heat is eventually dissipated through cooling and leakage out of the structure. As far as is known to applicant, no apparatus provides for recirculating the heated air that has risen to the ceiling back to the lower areas of the structure. Consequently the heat energy in the air in the upper levels of the building is lost.

SUMMARY OF THE INVENTION

It is accordingly a general object of this invention to provide an improved heating system for a building.

It is a further object of this invention to provide improved means for recirculating heated air that has risen to the upper levels of a building back to the lower levels.

It is a further object of this invention to provide improved means for recirculating heated air that has risen to the upper levels of a building back to a forced air space heater.

In accordance with these objects, an apparatus is provided for use with heaters or furnaces having blowers. The apparatus includes collecting means positioned near the ceiling for capturing heated air as it rises. Preferably the collecting means is a perforated duct located near the ceiling. The collecting duct extends the length of the building and is connected to a return duct at one end. The return duct extends vertically down to the intake side of the blower in the heater. The blower preferably runs continuously, drawing the heated air back to the heater for redistribution. If the burners are energized, the returned air, being warmer than the room air at that level in the building, requires less energy to heat it to desired discharge temperatures, thus conserves energy. If the burners are not energized, the warmer air is blown into the building for further heating.

DESCRIPTION OF THE PREFERRED EMBODIMENT

Figure 1:
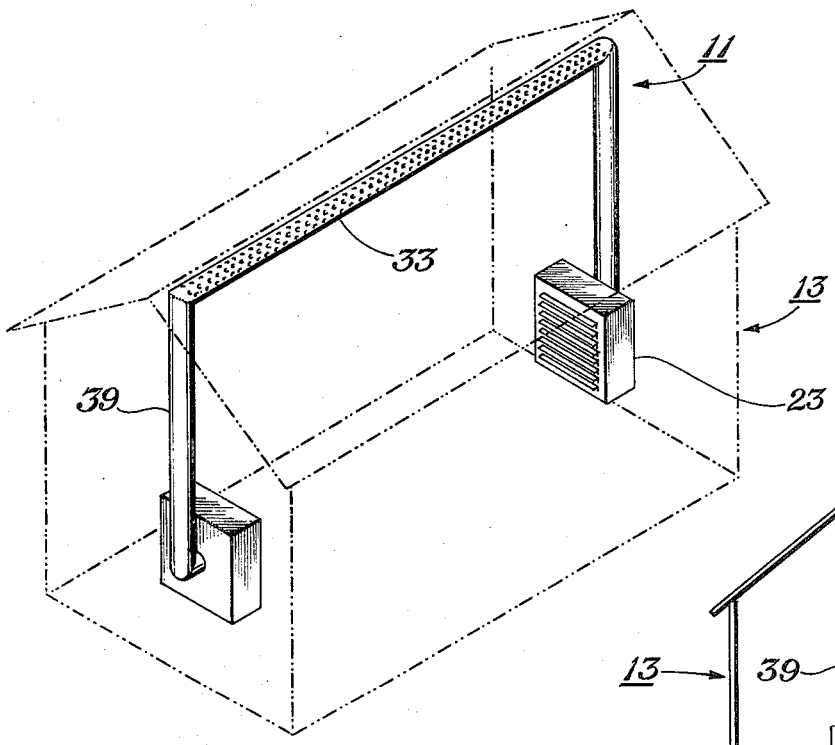
FIG. 1 is a perspective view of an apparatus for recirculating heated air constructed in accordance with the principles of this invention.
Figure 2:
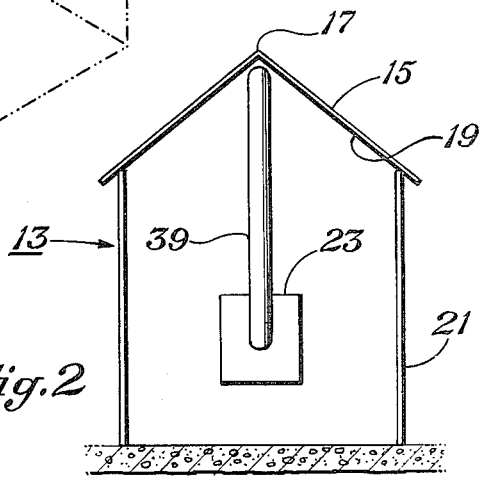
FIG. 2 is an end elevational view of the apparatus of FIG. 1.
Figure 3:
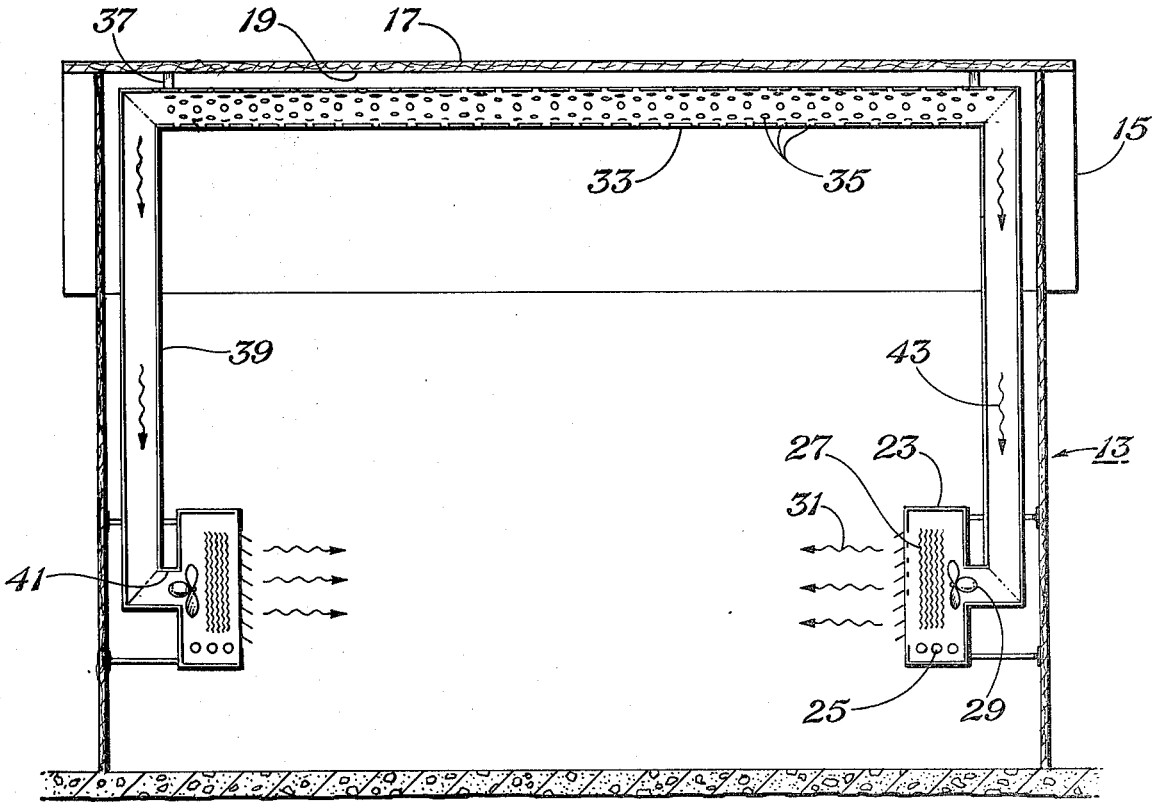
FIG. 3 is a cross sectional schematic view of the heating apparatus of FIG. 1.

Referring to the figures, a heat recirculating system 11 is shown enclosed in a building 13, shown in phantom. The building 13 is of the type typically used for chicken houses, having a double-pitched roof 15 with a peak 17 in the longitudinal center of the building. The roof 15 is preferably insulated, with the inner surface 19 serving as the ceiling of the building. The building has four walls 21.

A pair of furnaces or heaters 23 are mounted near each end of the building 13. These heaters contain burners 25 for heating a heat exchanger 27. A fan or blower 29 is mounted behind the heat exchanger for forcing air through the vents of the heat exchanger 27, heating and discharging air into the room, as indicated by arrows 31. The heaters 23 are mounted in or near the normal levels of occuppancy, four to ten feet from the floor, and may be gas or electrically energized.

The heated air, being lighter than cooler air in the room, rises to upper levels in the building. A collecting means comprising a duct 33 having a plurality of perforations 35 is mounted to the ceiling 19 at the peak 17 to collect the heated air. Duct 33 is preferably a cylindrical duct mounted to the ceiling 19 by brackets 37 and extending horizontally substantially the longitudinal length of building 13.

Return duct means for returning the collected air back to the heaters 23 includes a return duct 39 connected to each end of the collecting duct 33. Return duct 39 extends vertically to the air intake 41 of the heater 23. Air intake 41 is behind, or in communication with the space behind the fan 29, so as to create a suction in return duct 39 and collecting duct 33. Return duct 39 is also preferably a cylindrical duct.

In operation, fan 29 draws air from the return duct 39 and collecting duct 33, as indicated by arrows 43. This creates a pressure in the collecting duct 33 lower than the surrounding ambient pressure, inducing air near the ceiling 19 to enter perforations 35. As discharged heated air rises, it is drawn into collecting duct 33, and is recirculated back to the heaters 23.

The ducts, perforations, and heaters are dimensioned so as to create a circulation flow that results in a air temperature at the intake 41 substantially above the minimum ambient temperature at that level in the building. Heaters 23 are preferably of the type that operate with thermostatic controls to supply gas to the burner or energize the heat elements only when the ambient temperature has dropped below a selected minimum. The fans, however, are preferably continuously operated independent of the thermostatic control. Consequently, air drawn from the collecting duct will be continuously discharged into the building, adding heat to the lower occupied levels whether or not the burners are energized.

It should be apparent that an invention having significant improvements has been provided. The recirculating apparatus improves the efficiency of conventional heating systems in buildings by utilizing the heat contained in the air that has risen above the normal levels of occupancy in the building. The recirculating system is of simple structure, yet effectively recirculates heated air to the lower levels.

While the invention has been shown in only one of its forms, it should be apparent to those skilled in the art that it is not so limited but is susceptible to various changes and modifications without departing from the spirit thereof. For example, although the heat recirculating apparatus is particularly adaptable to peaked ceilings, the system is also adaptable to buildings having flat and other configurations of ceilings as well. A plurality of collecting ducts could be used, with or without hoods to direct the rising air upward and inward into the collecting ducts. Also, although the fans are shown located in the heater behind the heat exchanger, they could be positioned upstream in the return duct.

I claim:

1. In a room having a ceiling, an improved means for heating the room, comprising:

a pair of furnaces mounted opposing each other and on opposite ends of the room, each of the furnaces having a blower for discharging heated air into the room;

a collecting duct mounted adjacent the ceiling and extending substantially the length of the room, the collecting duct having a plurality of apertures for drawing air into the collecting duct;

a return duct connected to each end of the collecting duct and extending downward to the blower intake of each furnace, causing air that has risen into the collecting duct to be drawn down the return ducts and into the furnace to be discharged again.

2. The heating means according to claim 1 wherein the ceiling is double-pitched with a peak, and wherein the collecting duct is mounted in the peak.

* * * * *